US005637027A

United States Patent [19]

Palombo et al.

[11] Patent Number: 5,637,027

[45] Date of Patent: Jun. 10, 1997

[54] $CO_2$ JET SPRAY SYSTEM EMPLOYING A THERMAL $CO_2$ SNOW PLUME SENSOR

[75] Inventors: Mario P. Palombo; Matthew G. Driggs, both of Manhattan Beach; Werner V. Brandt, Redondo Beach, all of Calif.

[73] Assignee: Hughes Aircraft Company, Los Angeles, Calif.

[21] Appl. No.: 173,737

[22] Filed: Dec. 23, 1993

[51] Int. Cl.[6] ..... B08B 7/00

[52] U.S. Cl. ..... 451/7; 451/39; 451/53; 451/90; 134/7; 134/11

[58] Field of Search ..... 451/2, 7, 38, 39, 451/40, 53, 90, 102; 134/6, 7, 13, 11

[56] References Cited

U.S. PATENT DOCUMENTS

| | | | |
|---|---|---|---|
| 4,284,670 | 8/1981 | Kole . | |
| 4,389,820 | 6/1983 | Fong et al. | 451/39 |
| 4,617,064 | 10/1986 | Moore | 451/38 |
| 4,848,123 | 7/1989 | Thompson . | |
| 4,934,151 | 6/1990 | Shima . | |
| 5,184,427 | 2/1993 | Armstrong | 451/7 |
| 5,445,553 | 8/1995 | Cryer et al. | 451/7 |

FOREIGN PATENT DOCUMENTS

| | | |
|---|---|---|
| 0222258 | 5/1987 | European Pat. Off. . |
| 3622911A1 | 1/1988 | Germany . |
| 4030434A1 | 4/1991 | Germany . |
| 4135430A1 | 4/1993 | Germany . |
| 525032 | 8/1972 | Switzerland . |
| WO91./ 121237 | 8/1991 | WIPO . |
| WO92/20456 | 11/1992 | WIPO . |

*Primary Examiner*—Eileen P. Morgan
*Attorney, Agent, or Firm*—M. E. Lachman; M. W. Sales; W. K. Denson-Low

[57] ABSTRACT

$CO_2$ jet spray cleaning apparatus that monitors $CO_2$ snow plume characteristics. The present invention is a $CO_2$ jet spray cleaning system that comprises a holding tank for containing liquid $CO_2$, a spray nozzle coupled to the holding tank, a valve coupled between the holding tank and the spray nozzle, and a temperature sensor coupled to the nozzle for sensing the temperature of a plume of $CO_2$ that is sprayed by the nozzle and for providing a signal indicative thereof. The system may also comprise a display coupled to the temperature sensor for displaying the temperature of the plume of $CO_2$ to an operator, or an alarm coupled to the temperature sensor for alerting an operator that the temperature of the plume of $CO_2$ has risen to a predetermined level. Either the displayed signal or the alert signal indicates that the quality of the plume has diminished and that the liquid $CO_2$ in the holding tank should be replenished. The present $CO_2$ jet spray cleaning system and $CO_2$ snow plume sensor provide an indication of the proper $CO_2$ snow characteristics to an operator so that the system cleans in a proper manner.

10 Claims, 1 Drawing Sheet

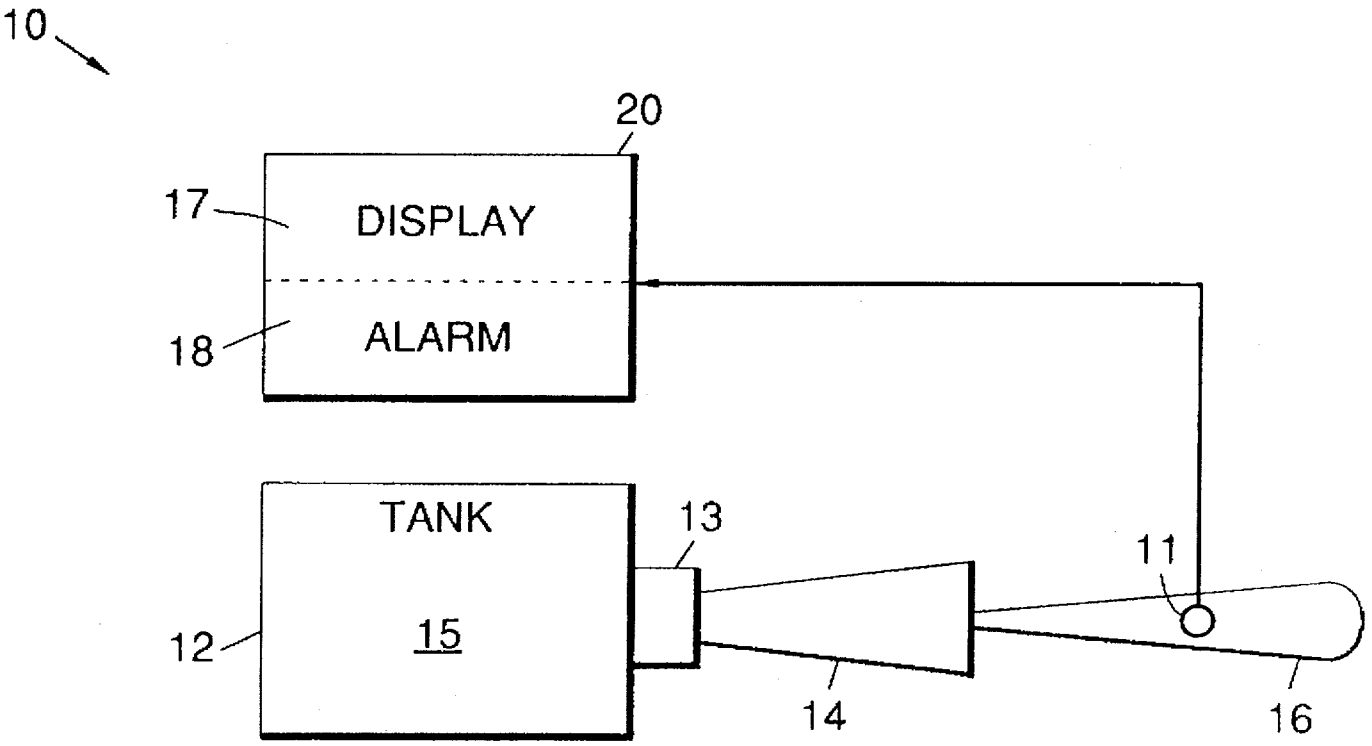
10
20
DISPLAY
ALARM
17
18
TANK
15
12
13
14
11
16

$CO_2$ JET SPRAY SYSTEM EMPLOYING A THERMAL $CO_2$ SNOW PLUME SENSOR

The present invention was made with Government support under Contract No. N00030-93-C-0002 awarded by the Department of the Navy. The Government has certain rights in this invention.

The present invention relates to $CO_2$ jet spray cleaning systems, and more particularly, to a thermal $CO_2$ snow plume sensor for use in such systems that detects and monitors characteristics of a $CO_2$ snow plume.

$CO_2$ jet spray cleaning is a proven cleaning process that utilizes liquid $CO_2$ that is convened to a snow plume when it expands through a nozzle. The $CO_2$ jet spray cleaning process uses chemicals that do not deplete the ozone layer. The $CO_2$ snow plume, when directed onto a surface, provides a cleaning action without using ozone depleting chemicals. Heretofore, proper utilization of the jet spray cleaning process has been achieved only by an operator with a trained eye. The operator visually inspects the $CO_2$ snow plume to determine whether it "looks right". This technique is imprecise, impractical and is dangerous to temperature-sensitive parts in the nozzle.

Various approaches for monitoring a $CO_2$ snow plume have been discussed or are under development by the assignee of the present invention. One method involves sensing the force of the $CO_2$ plume exiting a nozzle. This force varies as the $CO_2$ liquid is depleted. The plume is directed onto a force sensor that is correlated to $CO_2$ plume characteristics. A second approach is to utilize an optical source and detector to determine plume snow density, which can also be correlated to the plume characteristics. However, both of these methods are relatively complex, expensive and are relatively difficult to implement. Additionally, because these approaches require that the monitoring devices be located in a fixed position, they cannot be integrated into a cleaning nozzle, for example, and thus can only provide an indirect indication of the plume characteristics.

Therefore, it is an objective of the present invention to provide an improved $CO_2$ jet spray cleaning system that employs a thermal temperature sensor to detect and monitor the characteristics of a $CO_2$ snow plume.

SUMMARY OF THE INVENTION

In order to meet the above and other objectives, the present invention is a $CO_2$ jet spray cleaning system that comprises a holding tank for containing liquid $CO_2$, a spray nozzle coupled to the holding tank, a valve coupled between the holding tank and the spray nozzle, and a temperature sensor coupled to the nozzle for sensing the temperature of a plume of $CO_2$ that is sprayed by the nozzle and for providing a signal indicative thereof. The temperature sensor may comprise a thermocouple, or other conventional temperature sensing device, for example.

The $CO_2$ jet spray cleaning system may also comprise an output device such as a display coupled to the temperature sensor for displaying the temperature of the plume of $CO_2$ to an operator, or an alarm coupled to the temperature sensor for alerting an operator that the temperature of the plume of $CO_2$ has risen to a predetermined level. Either the displayed signal or the alert signal indicates that the quality of the snow plume has diminished and that the liquid $CO_2$ in the holding tank should be replenished.

The present invention thus provides for an improved $CO_2$ jet spray cleaning system that employs a $CO_2$ snow plume sensor. The use of the $CO_2$ snow temperature sensor is beneficial because without knowing the proper $CO_2$ snow characteristics the $CO_2$ jet spray cleaning system will not clean in a proper manner.

The present invention provides an indication when the $CO_2$ snow plume may be used for cleaning. It identifies when the $CO_2$ liquid is depleted from the holding tank. It protects thermally sensitive parts of the nozzle by sensing thermal changes in the snow plume. It may be used in a manual or automated cleaning system. It may be integrated into the nozzle to provide for continuous nozzle monitoring. All these advantages are provided by a simple, reliable, and inexpensive design that combines the nozzle and the thermocouple or other temperature sensor. The temperature sensor, when properly positioned in the snow plume, provides a signal indicative of temperature to plume correlation. This signal may be displayed to provide a manual readout or instrumented to trigger an automated response, such as an alarm, for example.

Without a $CO_2$ snow plume sensor, the reliability of the $CO_2$ jet spray system and cleaning process are greatly affected. Heretofore, there has been no technique available that provides all the advantages of the present invention while being inexpensive, reliable and easy to implement. It is believed that there are no currently available devices that provides the features of the present invention while monitoring $CO_2$ snow plume characteristics.

The present $CO_2$ snow sensor make the $CO_2$ jet spray cleaning process and system viable. The government has banned the use of ozone depleting chemicals in the near future and many companies such as the assignee of the present invention have made a commitment to phase out the use of ozone depleting chemicals in the manufacturing of their products. Presently ozone depleting chemicals are used to clean parts throughout industry and worldwide. There is therefore a need for the present invention by those using the $CO_2$ jet spray cleaning process and system, which provides an alternative to ozone depleting chemical usage.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which the sole FIGURE of the drawing illustrates a $CO_2$ jet spray cleaning system employing a thermal $CO_2$ snow plume sensor in accordance with the principles of the present invention.

DETAILED DESCRIPTION

Referring to the drawing FIGURE, it illustrates a $CO_2$ jet spray cleaning system 10 employing a thermal $CO_2$ snow plume temperature sensor 11 in accordance with the principles of the present invention. The $CO_2$ jet spray cleaning system 10 is comprised of a holding tank 12 that contains liquid $CO_2$ 15. A spray nozzle 14 is attached to the holding tank 12, and a valve 13 is disposed between the holding tank 12 and the spray nozzle 14. A temperature sensor 11, such as a thermocouple 11, or other conventional temperature sensing device, for example, is attached to or otherwise disposed in the spray nozzle 14 such that when the valve 13 is opened, liquid $CO_2$ 15 is ejected through the nozzle 14 for form a $CO_2$ snow plume 16, and the temperature sensor 11 senses the temperature of the $CO_2$ snow plume 16. An output device 20 such as a display 17 or an alarm 18 is coupled to the temperature sensor 11.

Through experimentation it has been discovered that plume temperature of the $CO_2$ snow plume 16 rises significantly as the quality of the $CO_2$ snow plume 16 and its cleaning effectiveness diminishes. Liquid $CO_2$ 15 in the holding tank 12 is at room temperature, and when it expands through the nozzle 14, the liquid changes to a solid (snow) and gives up heat. This results in a snow plume 16 having a temperature of about −85° F. As the quality of the snow plume 16 changes due to depletion of the liquid $CO_2$ 15 in the holding tank 12, a significant rise in plume temperature occurs. At −62° F. the snow plume 16 is considered to be unacceptable. The nozzle 14 is instrumented with the thermocouple 11 or other temperature sensor 11. As the plume temperature of the $CO_2$ rises, the quality of the snow plume 16 diminishes. The temperature sensor 11 or thermocouple 11 senses the change in temperature and provides a signal indicative thereof. This signal may be displayed or processed as desired to provide an audible alarm or an alert for an operator. The use of the display 17 or the alarm 18 coupled to the temperature sensor 11 alerts the operator that the temperature of the plume 16 has risen to a predetermined level, that the quality of the plume 16 has diminished, and that the liquid $CO_2$ 15 in the holding tank 12 should be replenished.

The present invention thus provides for an improved $CO_2$ jet spray cleaning system 10 that employs a $CO_2$ snow plume temperature sensor 11. The present temperature sensor 11 is beneficial because without knowing the proper $CO_2$ snow characteristics the $CO_2$ jet spray cleaning system 10 will not clean in a proper manner.

The present invention provides an indication when the plume 16 may be used for cleaning, and identifies when the liquid $CO_2$ 15 is depleted from the holding tank 12. The present invention protects thermally sensitive parts of the nozzle 14 by sensing thermal changes in the snow plume 16. The present invention may be used in a manual or automated cleaning system 10, and may be integrated into the nozzle 14 to provide for continuous monitoring of the nozzle 14. All these advantages are provided by a simple, reliable, and inexpensive design that combines the nozzle 14 and the thermocouple or other temperature sensor 11. The temperature sensor 11, when properly positioned in the snow plume 16, provides a signal indicative of temperature to plume correlation. This signal may be displayed to provide a manual readout or instrumented to trigger an automated response, such as an alarm, for example.

Thus there has been described a new and improved $CO_2$ jet spray cleaning system that employs a thermal $CO_2$ snow sensor comprising a thermal sensor to detect and monitor the characteristics of the snow plume. It is to be understood that the above-described embodiment is merely illustrative of some of the many specific embodiments that represent applications of the principles of the present invention. Clearly, numerous and other arrangements may be readily devised by those skilled in the art without departing from the scope of the invention.

What is claimed is:

1. A $CO_2$ jet spray cleaning system comprising:

a holding tank for containing liquid $CO_2$;

a spray nozzle coupled to the holding tank for producing a plume of $CO_2$ snow;

a valve coupled between the holding tank and the spray nozzle for controlling the flow of said liquid $CO_2$ from said tank to said nozzle; and a temperature sensor coupled to the nozzle and located in the path of said plume of $CO_2$ snow for sensing the temperature of said plume of $CO_2$ snow and for providing a first output signal indicative of said temperature.

2. The system of claim 1 wherein the temperature sensor comprises a thermocouple.

3. The system of claim 1 which further comprises an output device coupled to the temperature sensor, wherein said output device receives said first output signal from said temperature sensor and provides a second output signal indicative of the quality of the plume.

4. The system of claim 3 wherein the output device comprises a display coupled to the temperature sensor for displaying the temperature of the plume of $CO_2$ to an operator.

5. The system of claim 3 wherein the output device comprises an alarm coupled to the temperature sensor for alerting an operator that the temperature of the plume of $CO_2$ has risen to a predetermined level, that the quality of the plume has diminished, and that the liquid $CO_2$ in the holding tank should be replenished.

6. A $CO_2$ jet spray cleaning system comprising:

a holding tank;

liquid $CO_2$ disposed in the holding tank;

a spray nozzle coupled to the holding tank for producing a plume of $CO_2$ snow;

a valve coupled between the holding tank and the spray nozzle for controlling the flow of said liquid $CO_2$ from said tank to said nozzle; and a temperature sensor coupled to the nozzle and located in the path of said plume of $CO_2$ sensor for sensing the temperature of said plume of $CO_2$ sensor and for providing a first output signal indicative of said temperature.

7. The system of claim 6 wherein the temperature sensor comprises a thermocouple.

8. The system of claim 6 which further comprises an output device coupled to the temperature sensor, wherein said output device receives said first output signal from said temperature sensor and provides a second output signal indicative of the quality of the plume.

9. The system of claim 8 wherein the output device comprises a display coupled to the temperature sensor for displaying the temperature of the plume of $CO_2$ to an operator.

10. The system of claim 8 wherein the output device comprises an alarm coupled to the temperature sensor for alerting an operator that the temperature of the plume of $CO_2$ has risen to a predetermined level, that the quality of the plume has diminished, and that the liquid $CO_2$ in the holding tank should be replenished.

* * * * *